US005833708A

United States Patent [19]

Czaplak

[11] Patent Number: 5,833,708

[45] Date of Patent: Nov. 10, 1998

[54] METHOD FOR IMPROVED LUMBAR SPINE DISC FLEXION

[76] Inventor: Stanley Czaplak, 95 Prospect St., Utica, N.Y. 13501

[21] Appl. No.: 841,770

[22] Filed: May 5, 1997

[51] Int. Cl.[6] ..... A47C 20/02

[52] U.S. Cl. ..... 606/237; 5/652; 5/648; 297/423.41

[58] Field of Search ..... 606/237, 242; 297/452.21, 423.41; 5/630, 632, 648

[56] References Cited

U.S. PATENT DOCUMENTS

| | | | |
|---|---|---|---|
| 3,003,815 | 10/1961 | Zinn | 297/118 |
| 4,635,306 | 1/1987 | Willey | 5/431 |
| 4,777,678 | 10/1988 | Moore | 5/431 |
| 5,127,333 | 7/1992 | Chee | 297/458 |
| 5,193,238 | 3/1993 | Clute | 5/655 |
| 5,347,669 | 9/1994 | Neviaser et al. | 5/655 |

OTHER PUBLICATIONS

Trevor Bennet, brochure for "The Original Inflatable Bolster", 1991.

Journal of Clinical Chiropractic, Aug. 1991, Article of S. Czaplak.

*Primary Examiner*—Gary Jackson
*Assistant Examiner*—David O. Reip
*Attorney, Agent, or Firm*—August E. Roehric, Jr.; Hancock & Estabrook

[57] ABSTRACT

A device which positions a user in a posture for maintaining all of the lumbar discs in a maximally flexed, relatively low load configuration, as occasioned when in a deep squatting position, while eliminating the lower extremity discomfort experienced by those who have not developed an ability to maintain a deep squatting posture for a prolonged period of time, and a method of lumbar spine therapy.

2 Claims, 5 Drawing Sheets

METHOD FOR IMPROVED LUMBAR SPINE DISC FLEXION

BACKGROUND OF THE INVENTION

This invention relates in general to improving the flexion of the lowest two discs of the lumbar spine and, in particular, to assisting a person in maintaining a position wherein anterior disc height of the lumbar spine is minimized, and posterior disc height is maximized, to enhance maximum flexion of all the lumbar discs for precluding disc degeneration.

More specifically, but without restriction to the particular embodiment and/or use which is shown and described herein for purposes of illustration, this invention relates to a device and method for use by a person in maintaining a posture which places the lumbar spine in a position known to enhance flexion of all intervertable discs of the spine without the discomfort heretofore associated with maintaining such a position without the assistance of such a device.

It is well known that the intervertebral disc is the primary load bearing articular element of the human spine. The health of these discs is essential to the normal function of the spine as a whole, and the degeneration of these discs is the primary event leading to the degeneration of the supporting soft tissues and articulations of the spine. Healthy discs are difficult to injure, and degenerated intervertebral discs are known to be, by far, the commonest site of origin for low back pain and the cause of sciatic pain.

These intervertebral discs are avascular structures, and obtain the nutrients for good health from blood vessels in the adjacent bones and from tissue fluids surrounding the outer layers of the disc. For the discs of the lumbar spine it has been demonstrated that optimum delivery of nutrients by these transport systems is only obtained when the body is in postures which fully flex the intervertebral discs, i.e.: postures which minimize the anterior disc height and maximize the posterior disc height. This full flexed disc configuration results in a maximum rate of the transport processes of diffusion and fluid flow to those portions of the disc which typically show the highest incidence of degeneration. Therefore, maintaining such a posture frequently, and/or for prolonged periods of time, will help these discs maintain their normal form and function.

There also are several secondary advantages to intervertebral disc flexion of the lumbar spine in relaxed positions. These are:

1. Reduced compressive stress on the posterior portion of the outer layers of the disc, the annulus fibrosus, while simultaneously increasing the pressure in the central portion of the disc, the nucleus pulposus. By maintaining the posture achieved through the use of this device, the stability of the inner annulus fibrosus layers are increased and subsequent disc degeneration averted;
2. Increased tensile stress of the posterior annulus fibrosus which, in turn along with the tightening of the adjacent posterior longitudinal ligament, will reduce any protrusion of a lumbar disc into the spinal canal thereby relieving any potential pressure on spinal nerve roots;
3. Increased total volume of the spinal canal and lateral recesses, which is especially important in stenotic conditions where there has been a pathological or congenital narrowing of the spaces occupied by adjacent neural elements; and
4. Reduced compressive stress on the articular surfaces of the adjacent lumbar apophyseal joints and the subsequent reduction in osteoarthritic changes and low back pain.

It has been radiographically and clinically demonstrated that dysfunction of the lumbar spine is practically nonexistent among populations which utilize squatting as one of the primary positions of rest throughout the day, such as Eastern and primitive peoples. Among populations that use squatting positions less frequently than these above groups, but still very regularly, low back pain and sciatica are described as "unusual" and clinically evident disc herniations are "truly rare". In comparison, in the United States where maintaining a squatting position is quite unusual, over 25% of the population suffers from back pain at any given time, and over 80% will suffer from it at some time in their lives.

While it has been established that the adoption of relaxed, deep squatting postures on a daily basis would alleviate back pain and sciatica, most persons in Western society cannot adopt such a position for more than a short period of time. When such persons adopt a deep, flat-footed squatting posture for more than a short time, they experience pain (mostly in the knees, shins and ankles) and/or paresthesia or numbness (due to circulatory deficits) in the lower extremities. These difficulties are said to be due to developmental differences in the lower extremities.

SUMMARY OF THE INVENTION

It is, therefore, an object of this invention to address or minimize the causes of low back pain and sciatica.

Another object of this invention is to improve flexion of the intervertebral discs of the lumbar spine.

A further object of this invention is to fully flex the lowermost intervertebral discs of the lumbar spine.

Still another object of this invention is to reduce the compressive stress applied to the posterior portion of the annulus fibrosus of these discs while simultaneously increasing the pressure in the central nucleus pulposus portion of the disc.

Yet another object of this invention is to assist a user of this device in maintaining a deep squatting position for a prolonged period of time to obtain the benefits of this therapy without incurring the pain and discomfort heretofore incurred when attempting to maintain such a position even for a short time period.

These and other objects are attained in accordance with the present invention wherein there is provided a seat which positions a user in a posture for maintaining all of the lumbar discs in a maximally flexed, relatively low load configuration, as occasioned when in a deep squatting position, while eliminating the lower extremity discomfort experienced by those who have not developed an ability to maintain a deep squatting posture for a prolonged period of time.

DESCRIPTION OF THE DRAWING

Further objects of this invention, together with additional features contributing thereto and advantages accruing therefrom, will be apparent from the following description of a preferred embodiment of the invention which is shown in the accompanying drawings with like reference numerals indicating corresponding parts throughout and which is to be read in conjunction with the following drawings, wherein.

DESCRIPTION OF A PREFERRED EMBODIMENT

Figure 1:
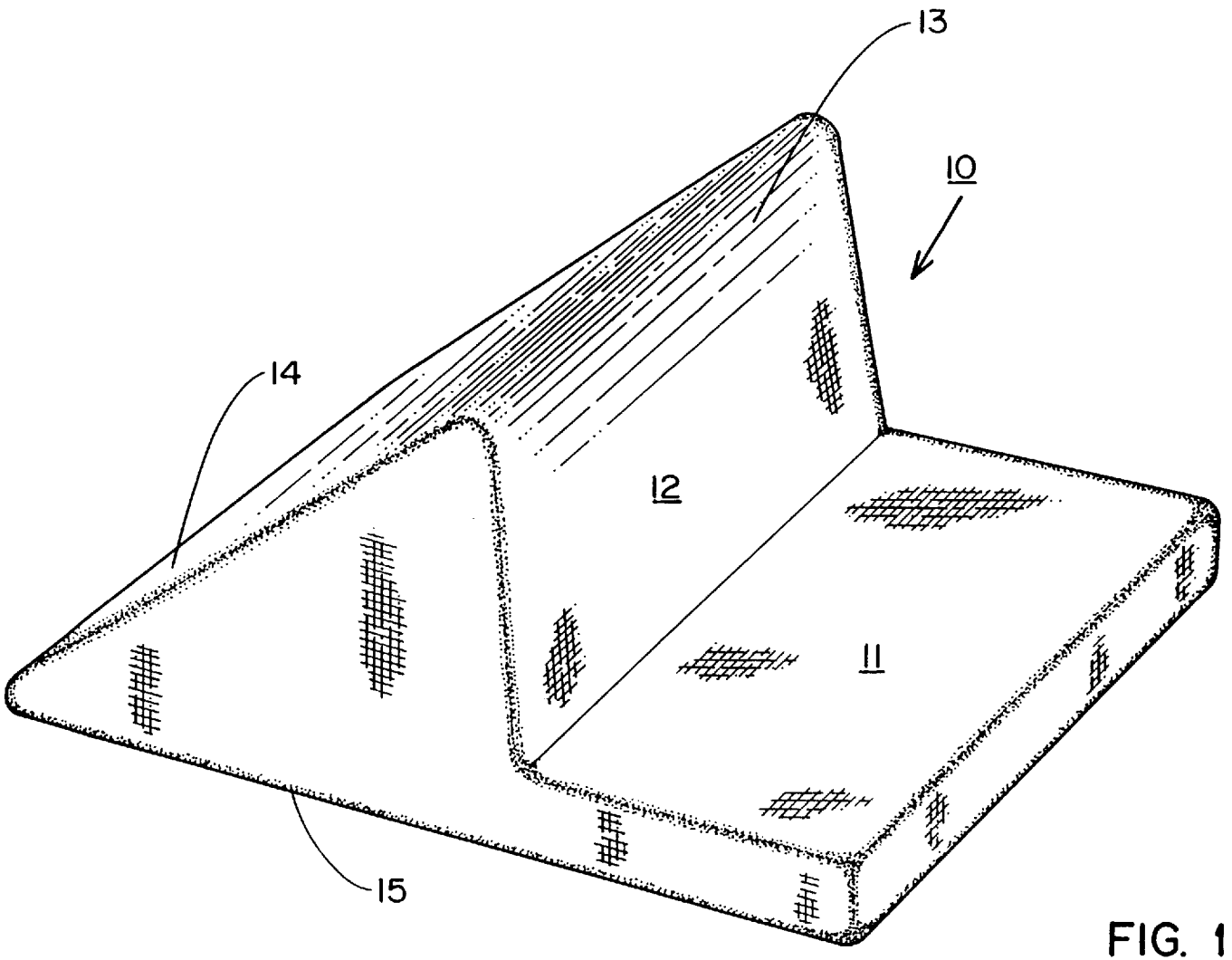
FIG. 1 is a perspective view of a seat constructed in accordance with the present invention to better illustrate the structure through which a user will be properly positioned to maintain the desired posture.
Figure 2:
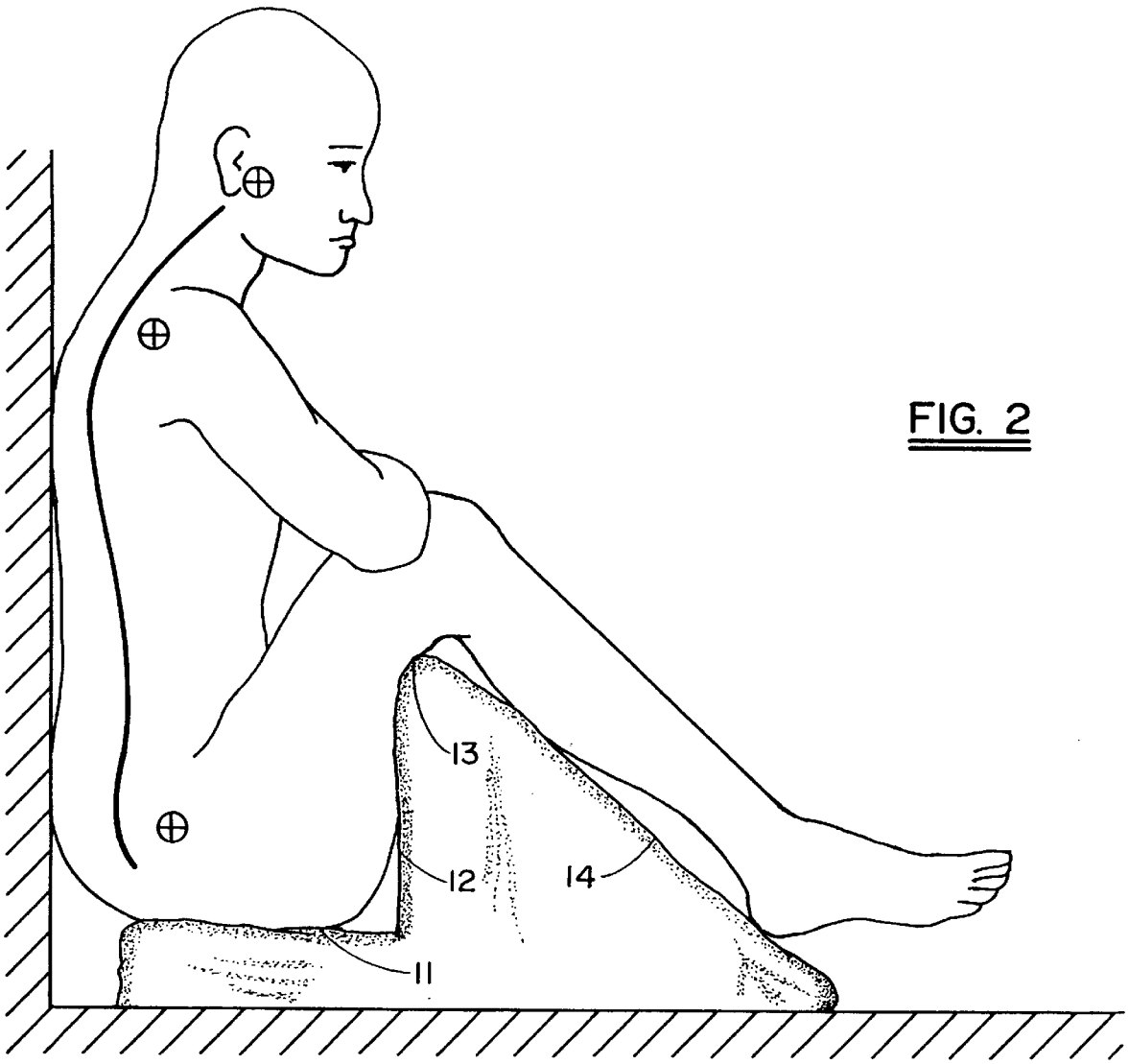
FIG. 2 is a diagrammatic representation of a person using the invention to simulate the posture of a deep squat without incurring the attendant discomfort associated with such a position by those who have not developed an ability to maintain such a posture for a prolonged period of time.
Figure 4:
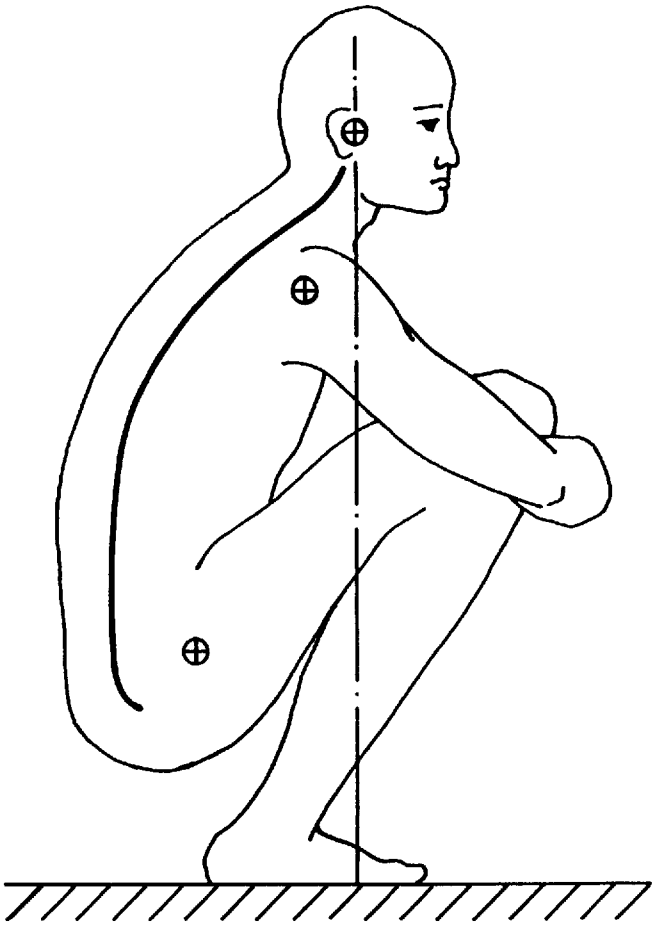
FIG. 4 is a diagrammatic representation of a person in a deep squatting position for comparison to the diagrammatic representation of FIG. 3, and the diagrammatic representation of a person using the embodiment of the present invention illustrated in FIG. 2.

Referring now to the drawings, there is illustrated in FIGS. 1 & 2 a seat 10 having a configuration for positioning a user such that all of the user's lumbar discs are maintained in a maximally flexed, relatively low-load configuration, as squatting would, while eliminating the lower extremity discomfort that would be occasioned if a deep squatting posture were to be assumed without the benefit of this device. When a user is properly positioned on the seat 10, as illustrated in FIG. 2, the user's intervertebral discs will be fully flexed in substantially the same manner as when an individual assumes a deep squatting position as illustrated in FIG. 4. This maximally flexed configuration of all the lumbar discs is obtained by maintaining the thighs in close proximity to the torso, as a squat would, without experiencing the lower extremity discomfort. The distribution of the stress from the knee joints, shins and ankle joints to the buttocks, posterior thighs, posterior knees and calves, and putting the knees in a partial rather than a full flexed position, allows a user to comfortably maintain this desirable position for a prolonged period of time.

Figure 3:
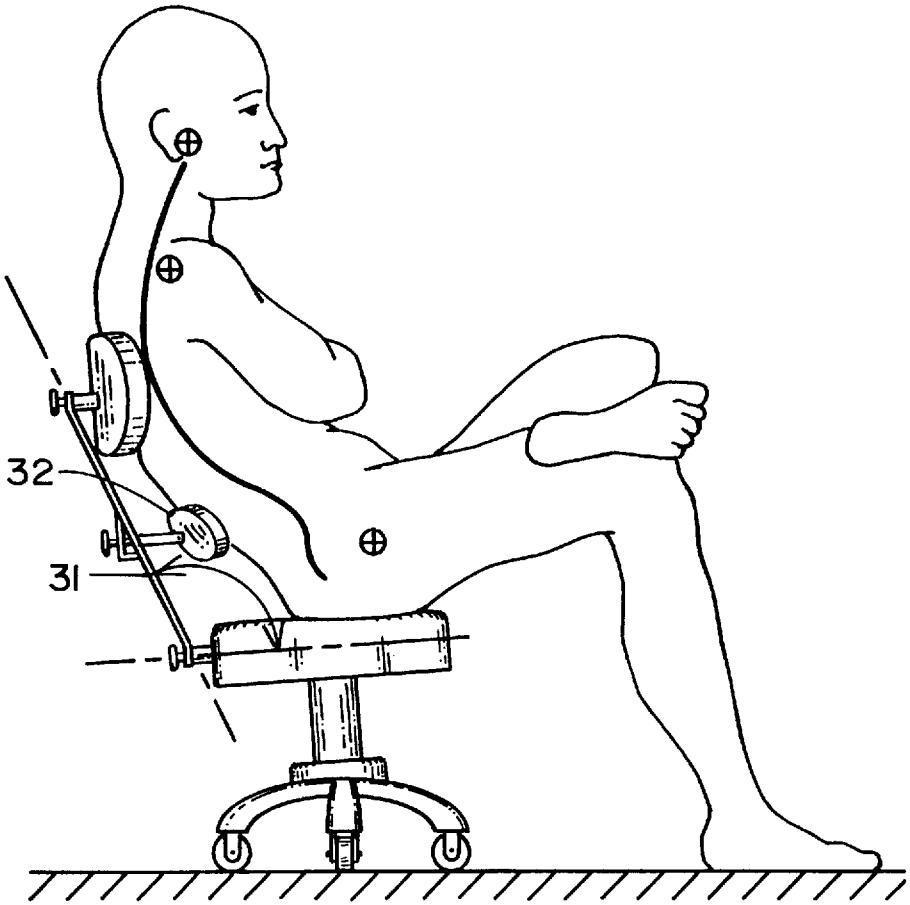
FIG. 3 is a diagrammatic representation of a person reclining in a common seated position for comparison to a position for obtaining the benefits of the therapy obtained through the instant invention.

In conventional chair design, illustrated in FIG. 3, two criteria were satisfied; muscle activity and internal disc pressure in the lumbar spine were minimized. Designers increased the backrest inclination 31, which increased the extension of most of the lumbar discs, and sometimes utilized a lumbar support 32 to maintain a lordosis (anterior curvature) in the lumbar spine. Such designs were done on the basis that the position producing the least internal disc pressures would be most beneficial to the lumbar discs. However, such a basis was not well founded, and it has been found that moderately higher internal pressures, such as those generated in a relaxed squatting position, are superior for the delivery of the nutrients so essential to healthy disc cells.

The seat 10 is preferably fabricated from a block of open cell polyurethane foam, having a density sufficient to support and cushion a user without being crushed into a permanent set. A removable covering of an upholstery material could be used to cover the foam, or a plastic spray could be applied to the foam surface to form a suitable protective coating for the underlying foam material, and the user. The seat 10 has a flat seat portion 11 for supporting a user's buttocks, and an adjacent wall 12 extending substantially vertically upward from the seat portion 11 at an angle of approximately 95 degrees. Although this 95 degree angle is preferred, it is believed that an angle of between 90 degrees and 105 degrees could still be used, and obtain the benefits of this therapy. The top of the wall 12 terminates in a curve 13 preferably having a radius of curvature of approximately 1 inch, thereafter a lower extremity support 14 slopes downwardly terminating at the point of joinder with the base 15 of the seat. While the radius of curvature is preferred to be 1 inch, this is a matter of user comfort and could range from substantially non-existent to 8 inches.

Figure 5:
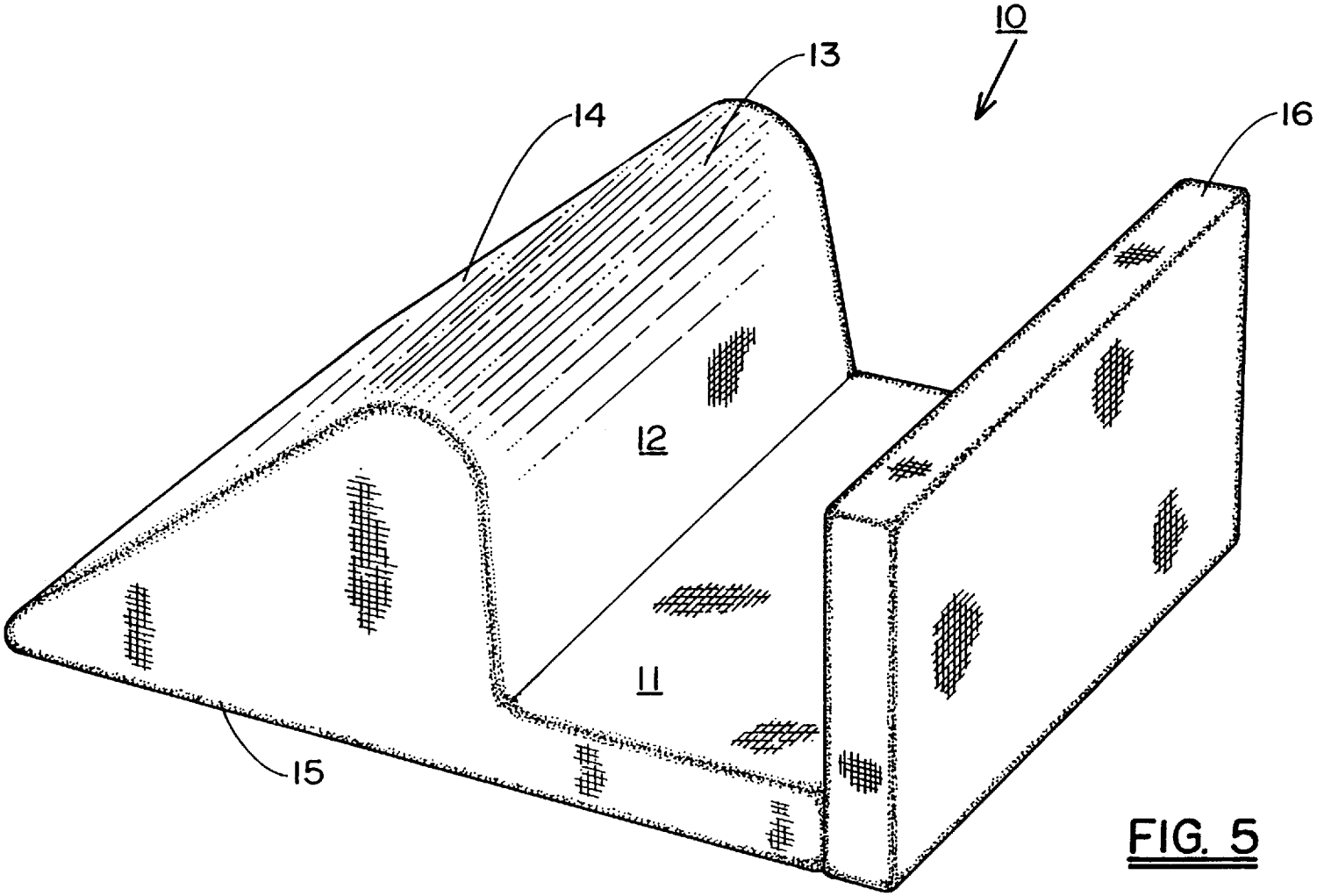
FIG. 5 is a perspective view of an alternative embodiment of the invention incorporating a back rest for the user.
Figure 6:
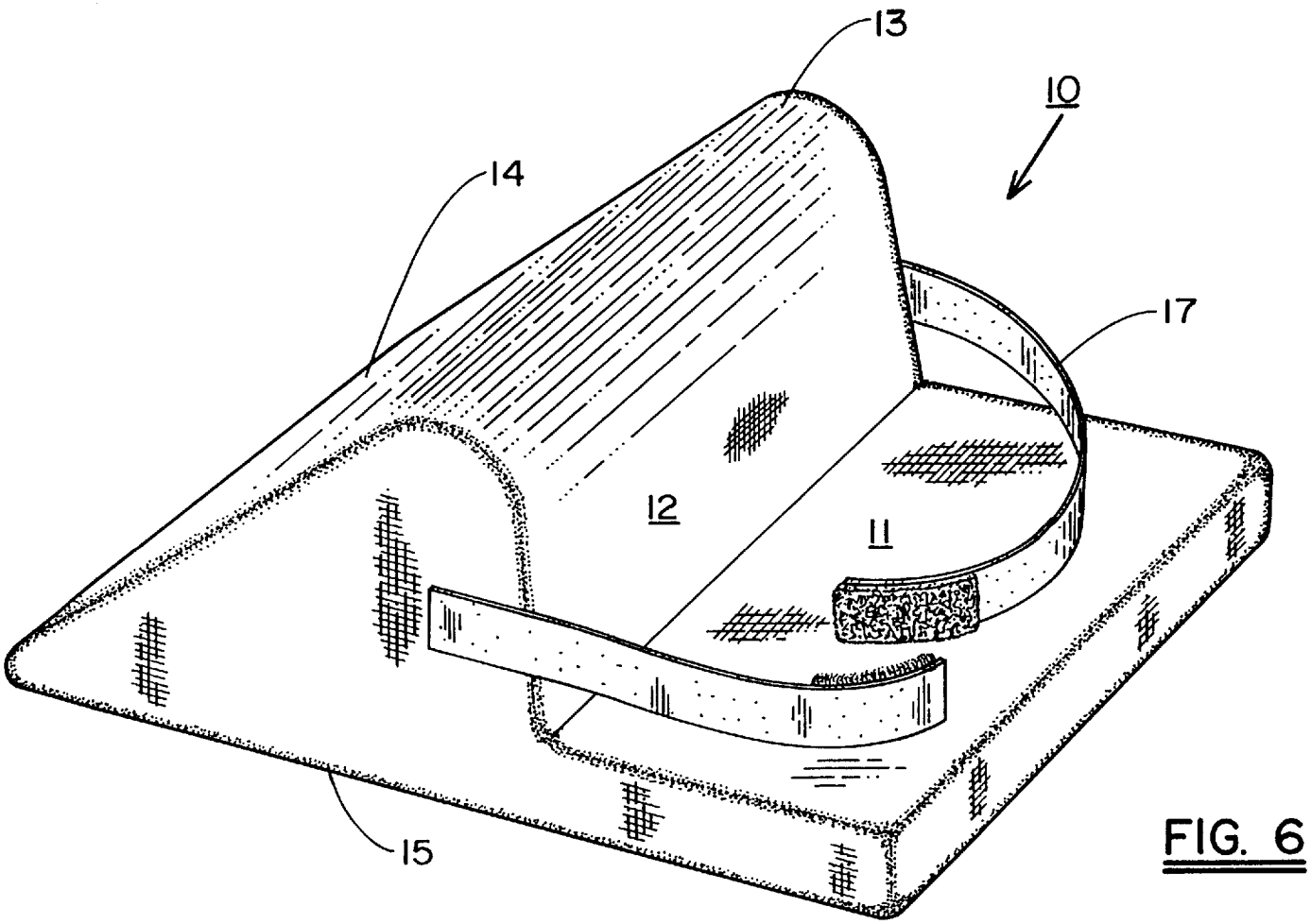
FIG. 6 is a perspective view of an alternative embodiment of the invention incorporating another form of back rest for the user.

As shown in FIG. 2, the seat 10 can be placed adjacent to a vertical wall for additional user comfort. To this end, the seat 10 could be modified to include an additional wall 16, at the end of the seat portion 11, which would extend vertically upwardly as illustrated in FIG. 5 to support a user's back when seated on the seat portion. Another form of back support that could be utilized by a user of the device, would be a belt 17 removably attachable to the sides 18 of the device and extending about the user's back as illustrated in FIG. 6.

While this invention has been described in the specification and illustrated in the drawings with reference to a preferred embodiment, the structure of which has been disclosed herein, it will be understood by those skilled in the art to which this invention pertains that various changes may be made and equivalents may be substituted for elements of the invention without departing from the scope of the claims. For example, the device could be air inflatable rather than being constructed of a foam material. In addition many other modifications, such as the permanent attachment of the belt to the sides of the device, and the use of a releasable hook and eye fastening system, such as sold under the trademark "VELCRO" for closing or attaching the belt to the device could be utilized. Therefore, it is intended that the invention not be limited to the particular embodiments disclosed in the specification and shown in the drawings as the best mode presently known by the inventor for carrying out this invention, nor confined to the details set forth, but that the invention will include all embodiments, modifications and changes as may come within the scope of the following claims:

What is claimed is:

1. A method of lumbar spine therapy, comprising the steps of:

placing a patient on a flat base having a substantially horizontal seat of a size sufficient to receive the patient's buttocks without room sufficient to receive the patient's posterior thighs, said seat having a forward user facing portion which terminates at a substantially vertically upwardly extending wall;

positioning the patient on said seat facing said substantially vertically upwardly extending wall with the patient's posterior thighs substantially parallel to said wall and with the upper portion of the patient's posterior thighs in contact therewith, the vertically upward height of said wall terminating by a curved surface for supporting the posterior knees of a user;

placing the patient's posterior knees over the curved surface to be supported thereby, the curved surface extending from the substantially vertically upwardly extending wall to a downwardly sloping surface for supporting the calves of a user; and supporting the posterior calves of the patient on the sloping surface.

2. The method of lumbar spine therapy as defined by claim 1 further including the step of supporting the back of a patient when seated on the seat.

* * * * *